US007108160B2

(12) United States Patent
Moretti

(10) Patent No.: US 7,108,160 B2
(45) Date of Patent: Sep. 19, 2006

(54) MANUALLY OPERABLE PUMP FOR DISPENSING CREAMY SUBSTANCES

(75) Inventor: Matteo Moretti, Crema (IT)

(73) Assignee: Lumson S.p.A., Capergnanica (IT)

( * ) Notice: Subject to any disclaimer, the term of this patent is extended or adjusted under 35 U.S.C. 154(b) by 0 days.

(21) Appl. No.: 11/000,082

(22) Filed: Dec. 1, 2004

(65) Prior Publication Data

US 2005/0279770 A1 Dec. 22, 2005

(30) Foreign Application Priority Data

Jun. 22, 2004 (IT) ..... MI2004A1249

(51) Int. Cl.
*B65D 88/54* (2006.01)

(52) U.S. Cl. ..... 222/321.7; 222/321.9; 222/385

(58) Field of Classification Search ..... 222/321.7, 222/321.8, 321.9, 385, 383.1, 321.1, 321.2
See application file for complete search history.

(56) References Cited

U.S. PATENT DOCUMENTS 3,583,605 A 6/1971 Corsette
5,482,188 A * 1/1996 Lina ..... 222/321.2
6,145,710 A * 11/2000 Carter ..... 222/321.9
6,196,424 B1 * 3/2001 Bougamont et al. ..... 222/321.9
6,209,759 B1 * 4/2001 Hermouet et al. ..... 222/321.2
6,446,841 B1 * 9/2002 Petit ..... 222/321.9
6,471,097 B1 * 10/2002 Hermouet et al. ..... 222/321.2
6,488,185 B1 * 12/2002 Beranger et al. ..... 222/385
6,554,160 B1 * 4/2003 Beranger et al. ..... 222/1
6,634,872 B1 * 10/2003 Bougamont et al. ..... 417/549
2004/0069811 A1 * 4/2004 Perignon et al. ..... 222/321.7

FOREIGN PATENT DOCUMENTS

DE 1728199 9/1968

OTHER PUBLICATIONS

U.S. Appl. No. 11/000,082, filed Dec. 1, 2004, Moretti.
U.S. Appl. No. 11/000,032, filed Dec. 1, 2004, Moretti.

* cited by examiner

*Primary Examiner*—Frederick C. Nicolas
(74) *Attorney, Agent, or Firm*—Oblo, Spivak, McClelland, Maier & Neustadt, P.C.

(57) ABSTRACT

A manually operable pump for dispensing creamy substances from a container on which the pump is mounted, and for preventing emergence or leakage of creamy substances along the outer surface of the pump stem when the pump is at rest and the container on which it is mounted is inclined to the upright position, with the pump at least partly immersed in the creamy substances. The pump comprises two separate seal regions provided between the pump main body and the piston and respectively the stem of the same pump.

4 Claims, 2 Drawing Sheets

MANUALLY OPERABLE PUMP FOR DISPENSING CREAMY SUBSTANCES

FIELD OF THE INVENTION

The present invention relates to a manually operable pump for dispensing creamy substances, the pump being formed in such a manner as to prevent accidental creamy substance leakage when the pump is in a rest position.

BACKGROUND OF THE INVENTION

Many types of manually operable pumps for dispensing creamy substances are known: some pumps have a very complex structure and are therefore costly, whereas other pumps have a simpler and more economical structure but present the drawback of allowing accidental leakage or emergence of the creamy substance at or about the outer surface of the pump operating and dispensing stem when the pump (mounted on a creamy substance container) is in a downward position relative to the container.

DISCUSSION OF THE RELATED ART

For example, DE 1728199A describes a pump having a cup-shaped body 8 and a hollow stem 2 on which a piston 11 is mounted and is sealingly slidable both on the surface of the compression chamber defined internally of the body 8 as well as on the outer surface of the stem in which a hole 4 communicating with the stem cavity is provided, said hole 4 being sealingly closed by the piston 11 when the pump is in its rest position. On the open end of the body 8 there is mounted a rigid profiled ring cap 1*a* having upwardly and downwardly projecting tubular appendices, one of which extends externally of the body 8 and is provided with a hole through which the stem 2 extends and is axially movable while leaving an annular passage 17 enabling free flow of air therethrough (as specified in the first paragraph of page 8 of the patent), the other tubular appendix 16 extending internally of the body 8 an has a free edge against which the piston 11 is pressed by a thrust of a collar 12 laterally projecting from the free end of the stem (when the pump is at rest) to sealingly close the passage 17 and prevent outflow of fluid substance externally of the pump when it is in its rest position (see second paragraph of page 8 of the German patent).

However, the pump disclosed in DE 1728199A does not prevent accidental leakage of fluid substance from the pump when it is at rest and is facing downwards with respect to the container on which it is mounted. Indeed, at least that amount of substance which may be present in the cavity delimited by piston 11, tubular appendix 16 and adjacent outer surface of the stem 2 will flow or pass to the outside of the pump through the passage 17, since the outer tubular appendix of the ring cap 1*a* acts only as a mechanical stop for the annular collar extending laterally from the stem 2, said passage 17 being sealingly closed (as already mentioned hereabove) only by the piston 11 when it is pressed against the free edge of the tubular appendix 16 which is positioned internally of the cup-shaped body 8.

SUMMARY OF THE INVENTION

The main object of the present invention is therefore to provide a pump of very simple and economical structure, which very effectively prevents infiltration or leakage of fluid at the outer surface of the pump stem when the pump is in its rest position.

This and further objects are attained by a pump comprising

- a cup-shaped body defining an intake and compression chamber for the creamy substance, which can enter the chamber at one end through a hole provided in the cup-shaped body and intercepted by a unidirectional valve,
- a hollow stem, of which a portion projects from the cup-shaped body and another portion extends into said chamber,
- a piston mounted on the stem and sealing both against the stem and against the opposing surface of said chamber, said piston bounding said chamber at its other end and being movable between a position in which it sealedly closes a hole provided in the stem and communicating with the stem cavity, and a position in which it leaves said hole free to enable the creamy substance to flow from said chamber to the outside of the pump through the-stem cavity,
- a spring acting between the cup-shaped body and the stem to urge this latter towards a sleeve which is rigid with the cup-shaped body on the outside of the pump chamber and has an opening through which said stem extends and is axially slidable, wherein said sleeve presents a first tubular lip against which said piston rests and seals when the pump is in its rest position, and a second tubular lip against which a first annular collar projecting from the stem outside the pump chamber rests and seals when the pump is in its rest position.

Preferably, inside the pump chamber there projects from said stem a second annular collar on which said piston rests when the pump is in its rest position, to close and seal against said stem hole which communicates with the stem cavity.

BRIEF DESCRIPTION OF THE DRAWINGS

The structure and characteristics of the pump will be more apparent from the ensuing description of one embodiment thereof given by way of non-limiting example with reference to the accompanying drawings, in which.

DETAILED DESCRIPTION OF THE INVENTION

Figure 1:
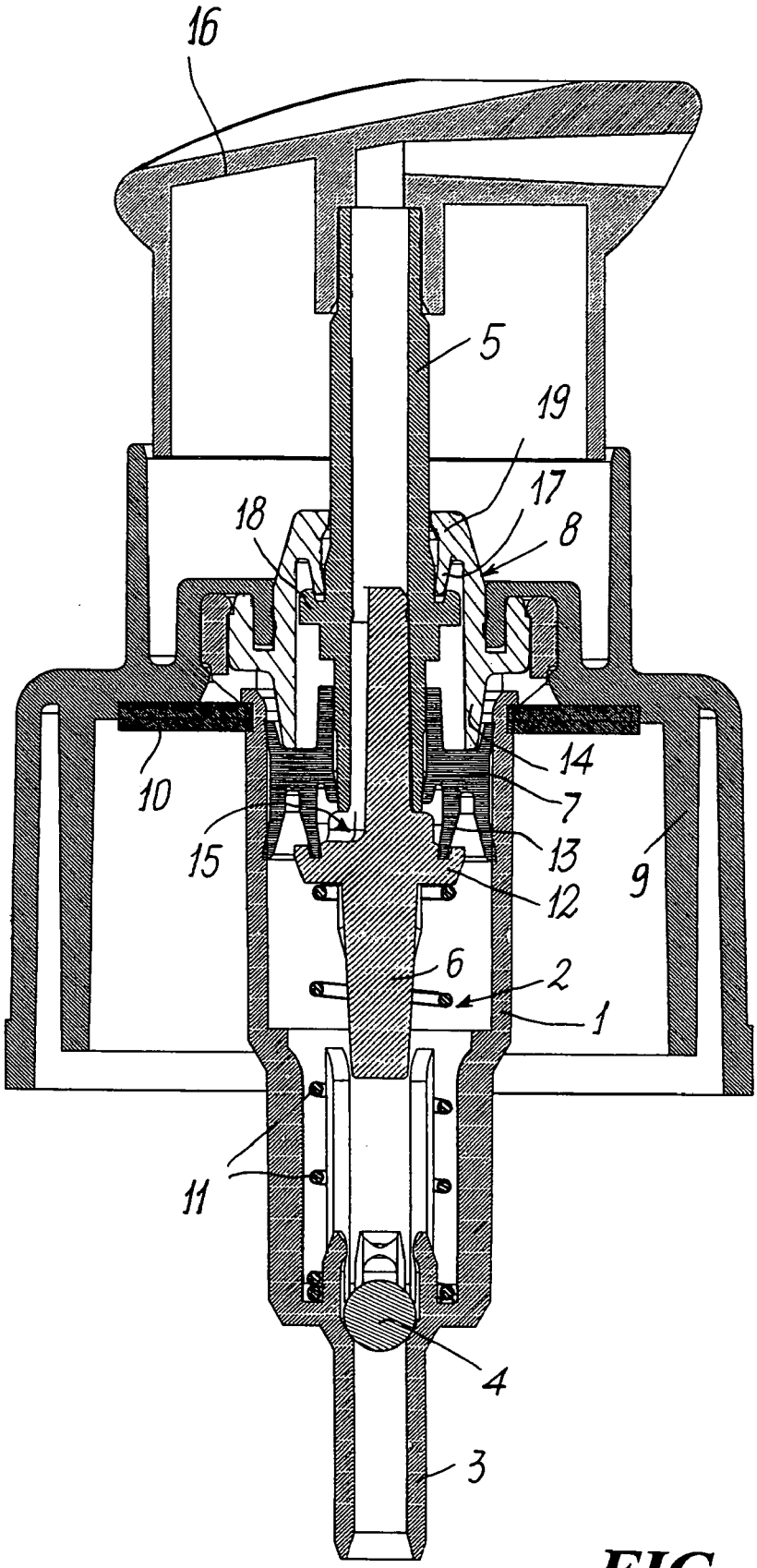
FIG. 1 is an axial section through the pump in its rest position.

The pump shown in the drawings comprises a cup-shaped body 1 defining a chamber 2 presenting at its lower end a hole from which there extends a hollow appendix 3 on which one end of a dip tube, not shown in the drawings for simplicity, can be sealedly mounted in known manner: at said hole there is provided a unidirectional valve comprising a ball 4 which can rest on and be sealedly urged (as shown in the drawings) against a seat provided at said hole, or can be raised away from said seat, to prevent outflow of fluid from the chamber 2 or to enable fluid to enter said chamber through the appendix 3 respectively.

The pump also comprises a hollow stem 5, of which the upper portion (with respect to the drawings) projects from the cup-shaped body and the lower portion (with which a peg 6 forms an integral part) extends into the chamber 2.

A piston 7 is mounted sealedly slidable on the stem 5 and is also sealedly slidable on the opposing inner surface of the body 1, in correspondence with the chamber 2.

A sleeve 8 is rigid with the upper end (again with respect to the drawings) of the body 1 and is sealedly locked onto the free edge of the body 1 by a profiled ring cap 9 which can be fixed (by way of an elastic seal ring 10) onto the mouth of a container (not shown for simplicity) on which the pump is to be mounted.

The interior of the chamber 2 houses a spring 11 which is compressed and acts between the base of the cup-shaped body and a collar 12 projecting from the hollow stem (specifically from the peg 6 which forms an integral part of the stem) in order to urge it upwards: when the pump is in the rest state (FIG. 1) the collar 12 is urged against a tubular lip 13 of the piston 7 (to seal against it), the piston in its turn being urged to seal against a tubular lip 14 projecting from the sleeve 8.

It can be seen from FIG. 1 that, when in the afore-described rest state, the piston 7 sealedly closes (with its lip 13) a hole 15 provided between the stem 5 and the peg 6 and communicating with the cavity of the stem, on the free end of which a dispensing pushbutton or cap 16 of known type is mounted.

Again examining the upper part of the figures of the drawings, there can be seen projecting from the sleeve 8 a tubular lip 17 on which there sealedly presses (when the pump is in its rest state of FIG. 1) an annular collar 18 which projects from the stem 5 outside the chamber 2 and above the piston 7.

Figure 2:
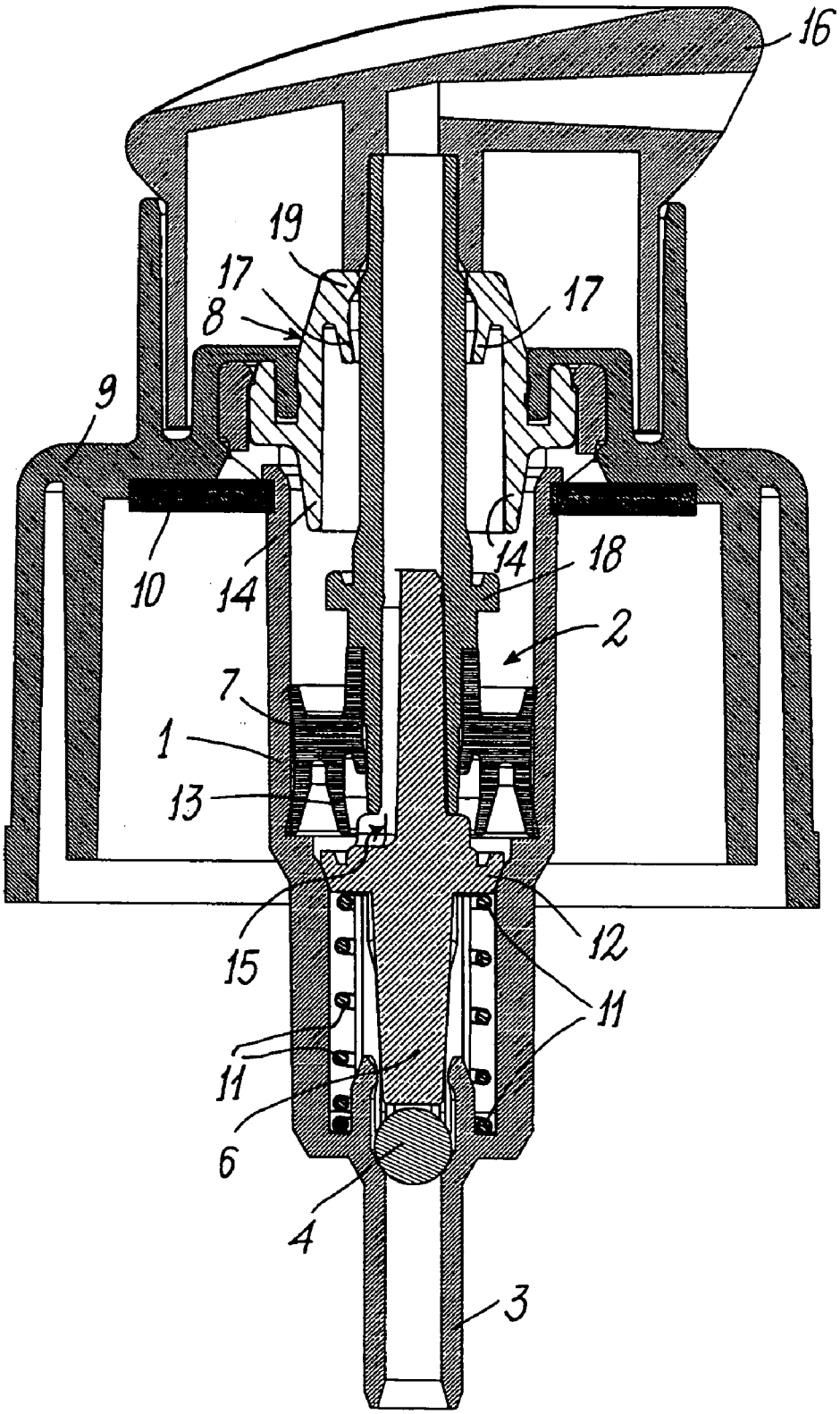
FIG. 2 is similar to FIG. 1, but with the pump operating stem pressed to the end of its dispensing stroke.

Finally it can be seen that the ring 10 is shaped such as not to seal against the outer surface of the body 1 (for example the ring 10 has a central hole with a profile different from that of the adjacent outer surface of the body 1), there projecting from the sleeve 8 an appendix 19 having an opening through which the stem 5 extends and is axially slidable, this appendix 19 also not sealing against the outer surface of the stem: the non-existence of a seal between the ring 10 and the body 1 and between the appendix 19 and the stem 5 is a known fact, necessary to enable external air to penetrate into the container on which the pump is mounted, when the pump is operated (for example when at the end of the dispensing stroke of FIG. 2) to draw into the chamber 2 the substance contained in the container and which the pump is intended to dispense.

The problem exists of preventing the fluid substance (which in the case of the described pump is of creamy type) from flowing or passing to the outside of the pump at the outer surface of the pump stem when the pump is at rest (FIG. 1) and lies with the pump facing downwards with respect to the container on which it is mounted, notwithstanding the existence of the said air passageways. In other words, the pump must be such as to enable air to enter the container when the pump is operated, but the pump must ensure a perfect seal against accidental leakages of creamy substance when the pump is at rest.

The presence of the two tubular lips 14 and 17, which project from the sleeve 8 and are simultaneously maintained pressed (by the spring 11) against the annular collars 12 and 18 respectively, enables a double seal to be achieved which prevents even minimal accidental leakage of the creamy substance from the pump, when this is in its rest position.

What I claim is:

1. A manually operable pump comprising:

a cup-shaped body defining an intake and compression chamber for a creamy substance, the cup-shaped body having a hole through which the creamy substance enters into the chamber at a first end of the cup-shaped body, the cup-shaped body having a unidirectional valve which intercepts the creamy substance;

a hollow stem having a portion which projects from the cup-shaped body and another portion which extends into said chamber;

a piston mounted on the hollow stem and sealing both against the hollow stem and against the opposing surface of said chamber, said piston bounding said chamber at a second end and being movable between a position in which said piston sealedly closes a hole provided in the hollow stem and communicating with a cavity of the hollow stem, and a position in which the hollow stem leaves said hole free to enable the creamy substance to flow from said chamber to the outside of the pump through the cavity;

a sleeve provided rigid with the cup-shaped body on the outside of the chamber and having an opening through which said hollow stem extends and is axially slidable; and a spring acting between the cup-shaped body and the hollow stem to urge the hollow stem towards the sleeve, wherein said sleeve includes a first tubular lip against which said piston rests and seals when the pump is in a rest position, and a second tubular lip against which a first annular collar projecting from the hollow stem outside the chamber rests and seals when the pump is in the rest position.

2. A pump as claimed in claim 1, wherein inside the chamber there projects from said hollow stem a second annular collar on which said piston rests when the pump is in the rest position, to close and seal said hole which communicates with the cavity.

3. A manually operable pump comprising:

a cup-shaped body having a first end and a second end, the cup-shaped body having an intake and compression chamber configured to receive a creamy substance and a hole formed at the first end, the hole allowing the creamy substance to enter into the chamber;

a unidirectional valve provided on the cup-shaped body and configured to intercept the creamy substance into the chamber from the hole at the first end;

a hollow stem projecting from the cup-shaped body and extending into the chamber and having a cavity, a hole communicating the cavity and chamber, and a first annular collar projecting from the hollow stem outside the chamber;

a piston sealing a gap between the hollow stem and an inner surface of the chamber at the second end such that the piston bounds the chamber at the second end, the piston being configured to move along the hollow stem between a position in which the piston sealedly closes the hole of the hollow stem and a position in which the piston opens the hole of the hollow stem;

a sleeve provided around the hollow stem outside the chamber of the cup-shaped body, the sleeve having a first tubular lip against which the piston rests and seals when the pump is in a rest position and a second tubular lip against which the first annular collar of the hollow stem rests and seals when the pump is in the rest position; and a spring positioned to act between the cup-shaped body and the hollow stem and to urge the hollow stem towards the sleeve.

4. A pump as claimed in claim 3, wherein the hollow stem further comprises a second annular collar on which the piston rests when the pump is in the rest position and closes and seals the hole communicating with the cavity.

* * * * *